US006882244B2

(12) United States Patent
Stenberg

(10) Patent No.: US 6,882,244 B2
(45) Date of Patent: Apr. 19, 2005

(54) SWITCHING SYSTEM FOR BROADCAST TRANSMISSION

(75) Inventor: James Stenberg, Portland, ME (US)

(73) Assignee: SPX Corporation, Charlotte, NC (US)

( * ) Notice: Subject to any disclaimer, the term of this patent is extended or adjusted under 35 U.S.C. 154(b) by 104 days.

(21) Appl. No.: 10/463,514

(22) Filed: Jun. 18, 2003

(65) Prior Publication Data

US 2004/0257170 A1 Dec. 23, 2004

(51) Int. Cl.[7] ..... H01P 5/12; H01P 5/22
(52) U.S. Cl. ..... 333/117; 333/109; 333/111
(58) Field of Search ..... 333/117, 109, 333/108, 101, 105, 121, 368

(56) References Cited

U.S. PATENT DOCUMENTS 4,119,931 A * 10/1978 Hudspeth et al. ..... 333/105

6,359,530 B1 * 3/2002 Grandchamp ..... 333/108

* cited by examiner

*Primary Examiner*—Daniel D. Chang
(74) *Attorney, Agent, or Firm*—Baker & Hostetler LLP

(57) ABSTRACT

An apparatus directs two high-power UHF transmitter signals to one or the other or a combination of output destinations as determined by the setting of control components. Redirection between outputs can be performed continuously under full power. Using the apparatus, synchronous amplifiers directed to the same output produce a signal with all of the power of both amplifiers. The signals can be shifted to the station load without shutting down the amplifiers. After a failure, the remaining amplifier can be redirected to provide a clean signal.

24 Claims, 4 Drawing Sheets

SWITCHING SYSTEM FOR BROADCAST TRANSMISSION

FIELD OF THE INVENTION

The present invention relates generally to broadcast radio frequency (RF) transmission apparatus. More particularly, the present invention relates to switching and combining systems for high-power broadcast transmitters.

BACKGROUND OF THE INVENTION

RF broadcasting transmission apparatus for connecting high power transmitters to their antennas uses either coaxial line or waveguide as determined by factors such as frequency, power level, distance between transmitter and antenna, height of antenna tower, number of channels to be transmitted, and the like. For Very High Frequency (VHF) television, as for FM radio broadcasting and the various business and other bands embedded within the VHF range, the frequencies are low enough—which means the wavelengths are long enough and the structures must be large enough—to make waveguide-based transmission lines and signal manipulation largely infeasible. For the Ultra-High Frequency (UHF) television band, as for business broadcast channels with comparably high frequencies and frequencies higher still, up into the so-called microwave bands, waveguide may have utility comparable to or superior to that of coaxial line for many purposes.

Functions commonly performed at lower frequencies with discrete passive elements such as resistors, inductors, transformers, capacitors, transmission line sections, and the like can be replaced in waveguide systems by tuned cavities, dimension changes, resonant pins, blocks of solid dielectric material, and other apparatus to achieve comparable effects to the conventional components while working well at the power levels called for in RF transmission systems. An example of this, termed a waveguide-based switchless combiner, can accept two inputs, each of which is a broadcast signal from a transmitter. If the two signals come from transmitters that are synchronized, such as by accepting synchronous excitation and being well matched dimensionally, and if the frequency range for the switchless combiner includes the full channel width of the signals, then the switchless combiner can split each signal into two orthogonal parts, pass them through two waveguide sections, and join them into a single signal that can deliver virtually the full energy of the two transmitters to the output waveguide or coaxial line that carries it to the antenna, effectively adding the signal strength of two lower-power transmitters.

A transmitter system including a combiner device commonly requires one or more mechanical switches to direct signals from the transmitters to the combiner and/or from the combiner to either an antenna for broadcast or a resistive dissipative load device for test. Use of such mechanical switches generally requires shutting off power to the transmitters and may call for performing partial disassembly of high-power apparatus to reroute signals. A desirable capability would be to alleviate the need for one or more mechanical switches as well as to allow testing and maintenance functions to proceed without shutting off known-good transmitters and without the necessity of taking a programming source off the air altogether.

A type of hybrid known in the art as a "magic tee" or 180 degree hybrid differs from a standard or rectangular 90 degree hybrid in producing a substantially full-power output from an in-plane output port for two coherent inputs, and a substantially evenly split output between the in-plane and orthogonal output ports for two inputs out of phase by 90 degrees. Where the inputs have opposite phase, substantially all of the energy exits by the orthogonal port.

Accordingly, there is a need in the art for a switching system for broadcast transmission that overcomes, at least to some extent, the problems associated with the use of mechanical switches along with combiners to switch individual transmitters in and out of the broadcast signal stream.

SUMMARY OF THE INVENTION

It is therefore a feature and advantage of the present invention to eliminate high-power mechanical switching devices from a broadcast signal path. It is another feature and advantage of the present invention to eliminate power dissipating devices from a broadcast signal path. It is another feature and advantage of the present invention to support filtering and combining of signals. It is another feature and advantage of the present invention to allow a single transmitter to be redirected from an antenna to a nonradiating load and back without shutting down power to that transmitter. It is another feature and advantage of the present invention to allow a single transmitter to be redirected from an antenna to a nonradiating load and back without shutting down power to other transmitters comprising the system. The above and other features and advantages are achieved through the application of a novel combination of switchless combiners and filter-combiners as herein disclosed.

In one aspect, the invention provides an output directing apparatus for RF transmission, comprising a four-port switchless combiner configured to accept input from two RF signal sources and to output two signals corresponding to the inputs, altered in phase relationship and relative magnitude by an adjustable amount; and a four-port filter-combiner configured to accept input from one or two RF signal sources of the same broadcast channel and to output one or two signals, as determined by the phase relationship between the input signals.

In another aspect, the invention provides an apparatus for directing high-power RF transmission signals, comprising means for accepting synchronous signals from a plurality of transmitters; means for optionally combining the constituent signals; means for directing the constituent signals to a plurality of output destinations in a plurality of configurations; and means for retaining signal path integrity during transitions between signal direction configurations, whereby impinging signals can continue to be accepted at representative power levels during transitions between configurations.

In yet another aspect, the invention provides a method of directing high-power RF transmitter signals, comprising the following steps: accepting signals from a plurality of synchronous broadcast transmitters at any level of matching of their respective signal strength; directing signals from a plurality of transmitters to a plurality of output destinations in a plurality of configurations; altering the phase relationship between the signals to a selectable degree; combining the signals from the transmitters to a selectable degree; and varying the directing and combining of the signals continuously without requiring interruption of transmitter signal flow.

There have thus been outlined, rather broadly, the more important features of the invention in order that the detailed description thereof that follows may be better understood, and in order that the present contribution to the art may be better appreciated. There are, of course, additional features of the invention that will be described below and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
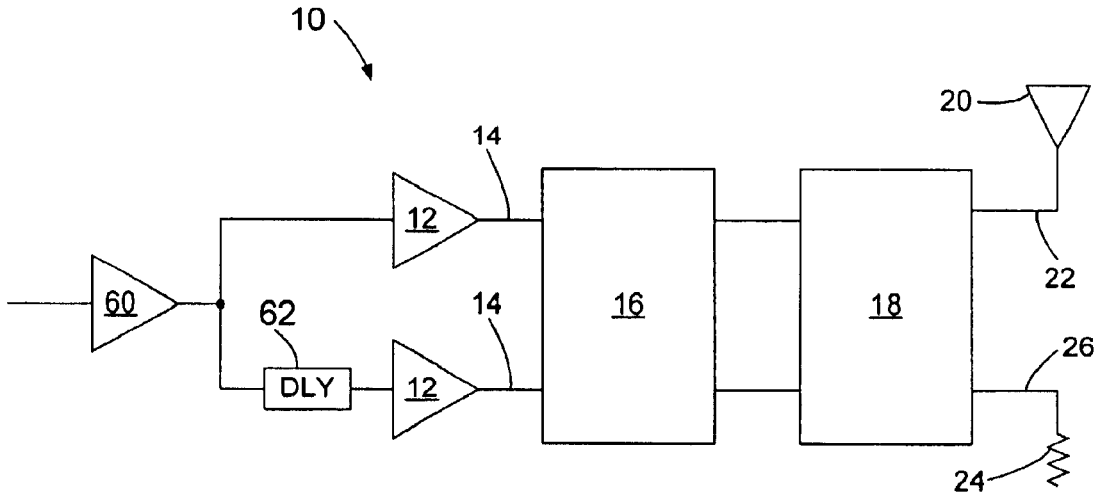
FIG. 1 is an overall schematic diagram summarizing a representative signal path, according to a preferred embodiment of the invention.

A preferred embodiment of the present invention includes a switchless combiner for each two input signal paths, and sufficient switchless combiners and filter-combiners to combine all of the available signals into a single output. A preferred embodiment of the present invention also employs one input port per signal source. Each signal source may be a high-power RF signal, typically a single UHF-band television channel signal, although a variety of other sources and frequency bands can be used with a suitably configured embodiment of the invention. A preferred embodiment of the present invention further employs a switchless combiner to avoid the need to deenergize any transmitter devices when redirecting one or more transmitter outputs. Preferred embodiments will now be described with reference to the drawing figures, in which like reference numerals refer to like parts throughout.

As shown in FIG. 1, a complete signal path for a preferred embodiment of a transmitter switching device 10 carries RF transmitter energy from a transmitter amplifier 12 via a coupling device 14 to a switchless combiner 16, from the output of which the signal travels via a filter-combiner 18 to two outputs, an antenna 20 (by way of a transmission line 22 of any length) and a station load 24 (by a length of transmission line 26).

Various terms of art for load resistors may be used herein. These include for example the generic term dummy load for any nonradiating RF absorber; the terms load and station load for a device with sufficient capacity to provide continuous (indefinite) dissipation of all RF transmitter outputs together; and the terms reject load and ballast load for a device typically intended to dissipate the off-frequency energy filtered out of a single transmitter, and thus commonly smaller in size and capacity than a station load.

Figure 2:
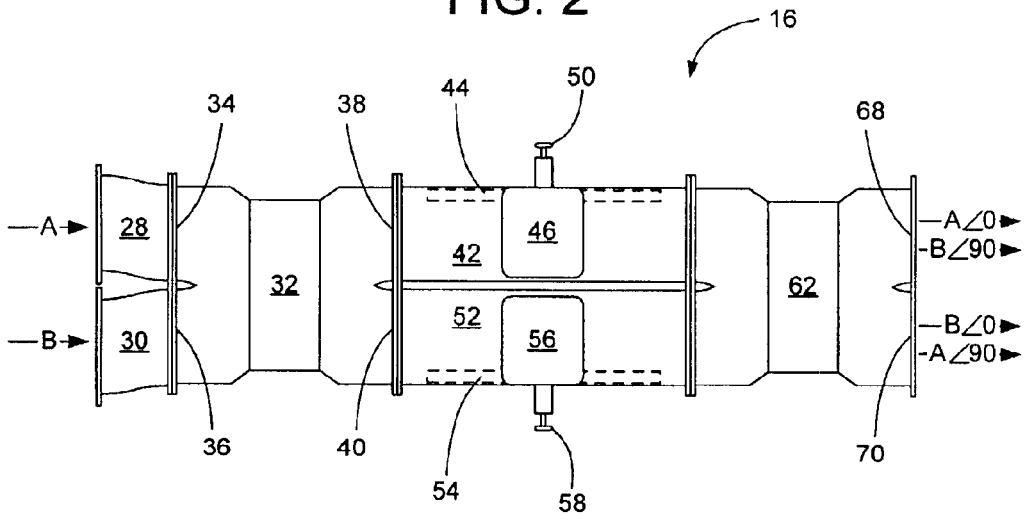
FIG. 2 is a plan view of a switchless combiner with two conventional hybrids that comprises a portion of a switching system.
Figure 3:
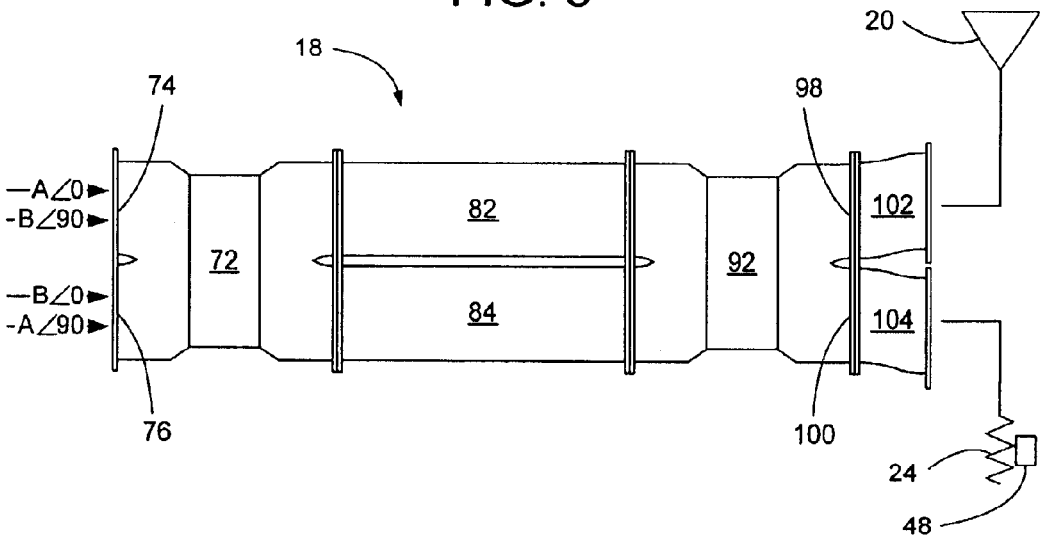
FIG. 3 is a plan view of a filter-combiner that comprises a portion of a switching system.

FIGS. 2 and 3 approximate the physical appearance of typical devices for implementation of the preferred embodiment. In the plan view of the switchless combiner, FIG. 2, input signals A and B are fed by way of first adapter fitting 28 and second adapter fitting 30 into a first hybrid 32. The first hybrid first input port 34 and first hybrid second input port 36 accept RF from two transmitters 12 (shown in FIG. 1 and FIG. 4); the first hybrid first output port 38 and first hybrid second output port 40 alter the signals in the following way: first hybrid first output port 38 has a divided share of first hybrid output A RF energy at nominal phase and a divided share of first hybrid output B RF energy delayed 90 degrees; first hybrid second output port 40 has a divided share of first hybrid output B RF energy at nominal phase and a divided share of first hybrid output A RF energy delayed 90 degrees. These signals can be combined or switched by the preferred embodiment of the inventive apparatus. The energy proportionality in the divided shares is preferably roughly equal.

The first hybrid first output port 38 feeds into the first phase shifter 42. The first phase shifter 42 includes a first dielectric block 44 positioned either automatically by a first motorized positioning apparatus 46 or manually by a first override device 50. The first hybrid second output port 40 feeds similarly into a second phase shifter 52 with apparatus elements comprising a second dielectric block 54, a second positioner 56, and a second override 58. When fully retracted, the first and second dielectric blocks 44 and 54, respectively, have no effect on propagation rate, which is the default propagation value for the first and second phase shifter assemblies 42 and 50 with the first and second blocks 44 and 54 fully retracted. Extending the first and second blocks 44 and 54 causes increased delay in signal propagation in their respective phase shifters 42 and 52. Maximum feasible delays can exceed 270 degrees of a cycle of RF energy when compared to the retracted rate for a realizable phase shifter.

The first and second dielectric blocks 44 and 54 are commonly made from solid polytetrafluoroethylene (PTFE) (available under for example the trade names Teflon® and Dyneon™), which is preferred for its low dissipation factor. Because of its low dissipation factor, the PTFE block can provide the necessary delay while minimally absorbing the RF energy and turning it into heat. Alternative materials can be used in substantially the same way as PTFE.

Positioning of first and second dielectric blocks 44 and 54 can be sufficiently repeatable using mechanical limit switches controlling drive motors in the first and second positioners 46 and 56 that producing a particular phase shift at a given channel frequency does not require feedback control on block position.

Block position accuracy can be verified in some block positions by detecting power level in the station load 24 (FIG. 1). When the station load 24 dissipated power is at a minimum, for example, it may be reasonably deduced that the blocks are positioned to maximize the power directed to the antenna 20. Complete system designs can, for example, use this property as a calibration test.

The phase shifters 42 and 52 shown in FIGS. 2 and 3 are illustrated using low-dissipation factor dielectric blocks 44 and 54, respectively, to perform any required phase shifting. Alternative phase shifter designs can be used. One such, a so-called trombone design, achieves phase shift with a transmission line that features a series of right-angle bends to allow a section of itself to be slid in and out, thereby shortening and lengthening the signal path while leaving the ends fixed. Another alternative phase shifter design inserts and retracts a series of pins spaced along a waveguide section, where increased insertion can correspond to increased phase shift. Other methods are likewise readily available to those knowledgeable in the art.

The transmitter amplifiers 12 (FIG. 1) that serve as the source of input signals to the switching apparatus can be matched in physical properties and output levels, and can typically be fed by a synchronous driver circuit 60 (FIG. 1) to provide excitation matched in amplitude and phase. Where appropriate, one of the individual amplifier drive signals, i.e., the inputs to the amplifiers, may be altered in phase, such as with a delay line 62 (FIG. 1), to establish a fixed delay of one signal with respect to the other. An equivalent technique can interpose an additional waveguide section in one of the two amplifier 12 output waveguides 14 feeding the combiner circuit 16, and thereby provide an equivalent fixed delay to that created by the delay line 62 feeding the switchless combiner 16. The delay device here termed fixed can be adjustable or otherwise subject to alteration, such as for fine tuning.

Referring again to FIG. 2, in the preferred embodiment, outputs of the first and second phase shifters 42 and 52 feed a second hybrid 62. If the B input signal lags the A by 90 degrees at the input to the switchless combiner 16 and the second phase shifter 52 is so adjusted as to delay the hybrid output by another 90 degrees, then there is effectively no signal present on a second hybrid first output port 68, and both signals will be present substantially at full strength and in phase on a second hybrid second output port 70. Adjusting the second phase shifter 52 to 0 degrees or 180 degrees instead of 90 degrees shifts the B signal, in the 0 degree case, or the A signal, in the 180 degree case, to the second hybrid first output port 68. Shifting the second phase shifter 52 to 270 degrees lag at the transmit frequency places both amplifier signals on the second hybrid first output port 68.

Referring to FIG. 3, for the waveguide filter-combiner 18, the preferred embodiment can use input hybrid 72 and output hybrid 92 with first waveguide filter section 82 and second 84 waveguide filter section between, and can have the filters of the first and second waveguide filter sections 82 and 84 comprised of cascaded cavity resonators tuned to a specific channel frequency and dimensioned for the required filter performance at that frequency. If substantially all of the RF energy from the switchless combiner 16 is directed to the second input 76 of the input filter hybrid 72, then substantially all of the energy will be directed by the filter-combiner 18 to the first output 98 of the output filter hybrid 92, from which port it can be fed by way of a first output adapter 102 and the high-power RF conductor 22 to the antenna 20. If substantially all of the RF energy is instead directed to both the first input port 74 and the second input port 76 of the input hybrid 72, then the energy directed to the second port 76 can still go by way of first output adapter 102 to the antenna 20, but the energy directed to the first port 74 can instead be directed to the second output port 100 of the filter-combiner 18, and thence by way of second output adapter 104 to the station load 24. Similarly, substantially all of the energy can be input to the first port 74, in which case substantially all of the energy can be directed to the station load 24. This set of options allows substantially all of the transmitter 12 energy to be broadcast on the antenna 20, and further allows either one of the transmitters 12 to drive into the station load 24 for testing, as well as allowing the entire station signal to be directed into the station load 24.

As indicated in the discussion of FIG. 2, the second phase shifter 52 can provide continuous adjustment of the phase angle of the signal passing through it. As the phase angle changes, the balance between the outputs can likewise change continuously, including placing the entire signal from either one or both of the transmitters onto the station load 24 or onto the antenna 20. Because the low dissipation factor is intrinsic to the PTFE or equivalent material used for the dielectric blocks 44 and 54, a phase shifter designed and sized according to the preferred embodiment can be one that can operate continuously at any power setting and at any phase angle setting without damage to itself and without producing significant changes in impedance that would create reflections. This can permit the same functional performance otherwise achieved by a system with mechanical switches to be achieved by adjusting controls by hand or under the control of motors and limit switches.

In the event of a shutdown-type failure of either transmitter, for a system configured to drive the antenna with all of the power of two substantially equal transmitters, a system designed according to the preferred embodiment can divide the power from the remaining transmitter equally between the output ports 68 and 70 without adjustment. This mode can be readjusted; setting the dielectric blocks 44 and 54 to an intermediate position can redirect all of the remaining energy to the switchless combiner output port 70, which will direct the energy to the antenna 20. A power sensor 48 can be embedded in the station load 24 (FIG. 3) to confirm that the single-transmitter power distribution arrangement is optimal, that is, that the amount of power sent to the station load 24 is minimized. The setting, however, can be sufficiently repeatable to allow the reconfiguration to be controlled by motors and position sensing switches rather than power or temperature sensors on the load.

Figure 4:
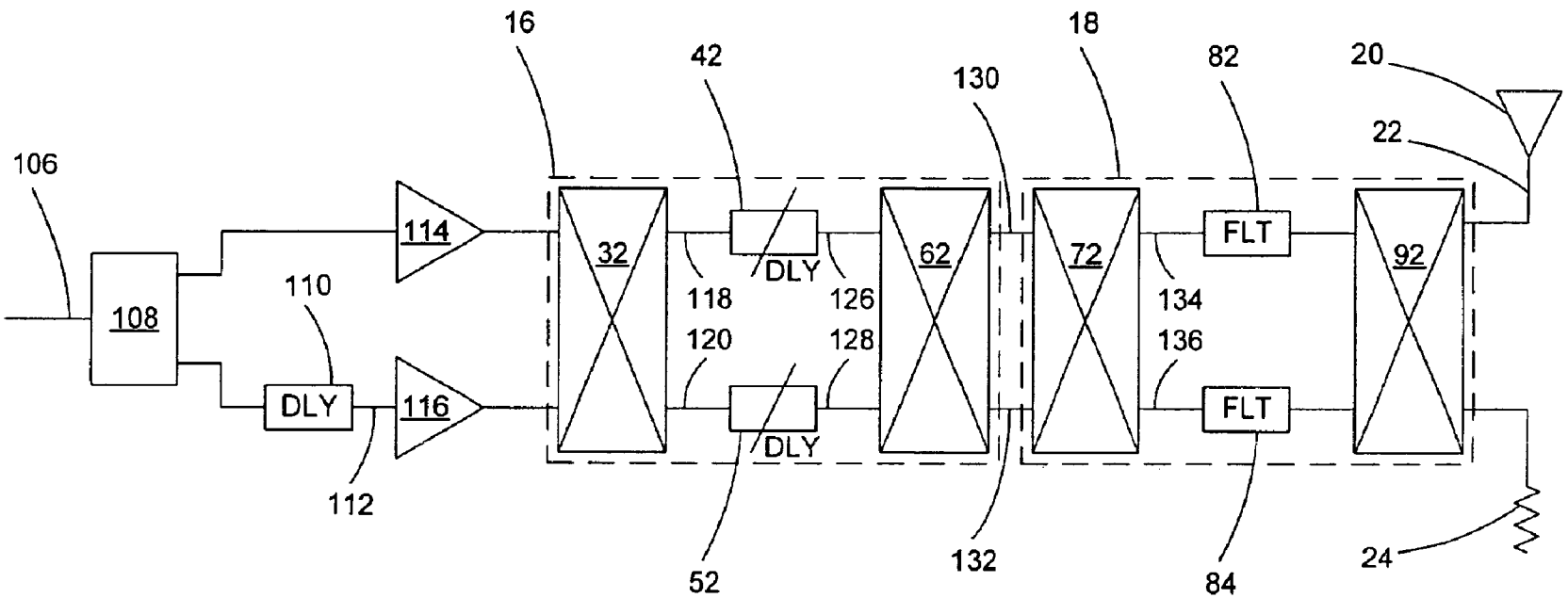
FIG. 4 is a block diagram of a switchless combiner with two conventional hybrids and a filter-combiner, together forming an operational switching system.

FIG. 4 shows a schematic of the preferred embodiment. A signal source 106 drives a power divider 108; from this a time delay 110 adjusts the phase on one signal 112 so that the first amplifier 114 leads the second amplifier 116 by 90 degrees at the center frequency of the broadcast signal. The preferred embodiment provides for a system in which low-level signals can be used to drive the amplifiers 114 and 116, which can output signals at the level of multiple kilowatts.

As illustrated in FIG. 4, the RF amplifier signals, outputs of the first amplifier 114 and the second amplifier 116, differ in phase by 90 degrees. Fed into the first hybrid 32 of the switchless combiner 16, each of the signals exits by both output ports, as represented in this schematic by a first signal path 118 and a second signal path 120. The output energy emitted diagonally across from each input lags the output energy emitted horizontally across from the input by 90 degrees. The two signals in each waveguide phase shifter are isolated by about 30 dB.

Passing through the adjustable phase shifters 42 and 52, the signals can retain their isolation but may be delayed to the extent required by the application and permitted by the details of phase shifter design. At the intermediate nodes 126 and 128, the signals may be found to have been altered in relative phase, so that their recombination in the second switchless combiner hybrid 62 may produce effectively any desired phase relationship at the switchless combiner 16 output nodes 130 and 132.

If the switchless combiner 16 is so configured that the signal at the second switchless combiner hybrid 62 second output node 132 contains substantially all of the RF energy from the transmitters, the energy can be directed by the filter combiner 18 to the transmission lines 22 leading to the antenna 20. In that case, passage of the RF energy through the filter-combiner 18 consists of division of the signal in the filter-combiner first hybrid 72 into an in-phase component found at a first hybrid second output node 136 and a lagging component at a first hybrid first output node 134, followed by filtering of these two components in the first filter 82 and the second filter 84, respectively, followed by recombination into an in-phase signal in the output hybrid 92 at the entry to the antenna transmission line 22.

Figure 5:
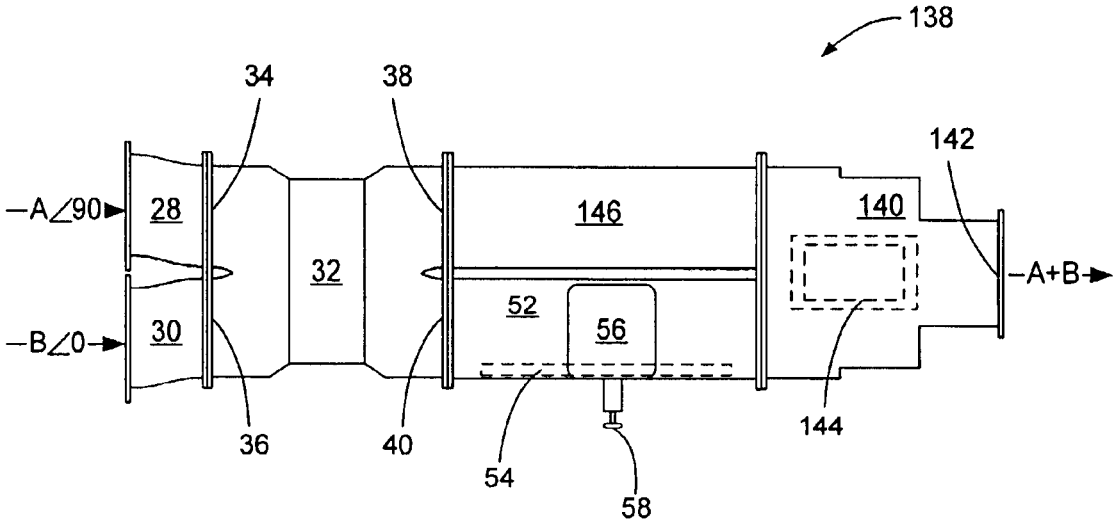
FIG. 5 is a plan view of a switchless combiner with one conventional hybrid and one magic tee combiner, comprising a portion of a switching system.

As illustrated in FIG. 5, which is an alternative embodiment of the switchless combiner function 138 of the improved switching system 10, the phase shifter 52 output can feed an alternative final switchless combiner element, a style of hybrid known in the art as a magic tee or 180-degree hybrid 140. The magic tee 140 differs from a standard hybrid in producing a substantially full-power output from an in-plane output port 142 for two coherent inputs, and a substantially evenly split output between the in-plane 142 and orthogonal 144 output ports for two inputs out of phase by 90 degrees. Where the inputs have opposite phase, substantially all of the energy exits by the orthogonal port 144. Use of the magic tee 140 as a component of a switchless combiner may require that a signal impinging on the first input port 34 be out of phase by 90 degrees from a signal impinging on the second input port 36. If the lagging signal is on the first input port 34 and if the second phase shifter 52 is set to introduce a lag of zero degrees, then the signals impinging on the magic tee 140 itself may be effectively in phase, allowing substantially all of the energy applied to the switchless combiner to emerge at the in-plane port 142 of the magic tee 140. Both outputs of the switchless combiner 138 must still be applied to the filter combiner 18 to form the complete embodiment of the improved switching system.

It may be possible to use a single phase shifter, corresponding to the second phase shifter 52 in FIG. 2, and to make no provision for a first phase shifter, such as element 42 of FIG. 2, using instead a fixed-delay waveguide section 146. A sufficient range of adjustment in the sole phase shifter 54 allows the full range of function to be maintained. The orthogonal output port 144 of the magic tee 140 may be fitted with appropriate waveguide to allow it to feed the first input port 74 of the filter combiner without using a ballast load.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, that fall within the scope of the invention.

What is claimed is:

1. An apparatus for directing the output of RF transmission devices, comprising:

a four-port switchless combiner configured to accept input from two RF signal sources and to output two signals corresponding to the inputs, altered in phase relationship and relative magnitude by an adjustable amount; and a four-port filter-combiner configured to accept input from one or two RF signal sources of the same broadcast channel and to output one or two signals, as determined by the phase relationship between the input signals.

2. The directing apparatus of claim 1, wherein said switchless combiner further comprises:

a first four-port switchless combiner hybrid configured to accept two RF signal inputs on its two waveguide input ports and to output two isolated RF signals on each of its two waveguide output ports, where each straight-through RF signal path produces nominal phase delay and each diagonal RF signal path has nominal phase delay plus 90 degrees;

a first two-port waveguide phase shifter, positioned to accept RF signals on its one waveguide input port and output RF signals on its one waveguide output port, the output of which phase shifter is a first set of RF signals matching the input except for a propagation delay affecting all applied signals, the extent of which delay can be changed; and a second four-port switchless combiner hybrid, functionally identical to the first four-port switchless combiner hybrid, and configured to operate in the reverse mode, accepting four isolated RF input signals on two waveguide input ports and combining them to form two RF output signals on two waveguide output ports.

3. The directing apparatus of claim 1, wherein said switchless combiner further comprises:

a first four-port switchless combiner hybrid configured to accept two RF signal inputs on its two waveguide input ports and to output two isolated RF waveguide signals on each of its two waveguide output ports, where each straight-through RF signal path produces nominal phase delay and each diagonal RF signal path has nominal phase delay plus 90 degrees;

a first two-port waveguide phase shifter, positioned to accept RF signals on its one waveguide input port and output RF signals on its one waveguide output port, the output of which phase shifter is a first set of RF signals matching the input except for a propagation delay affecting all applied signals, the extent of which delay can be changed; and a second four-port switchless combiner hybrid equipped with a coplanar waveguide output port and an orthogonal waveguide output port, configured to accept two RF signal inputs on its two waveguide input ports and to output two RF signals on its two waveguide output ports, where the coplanar waveguide output port carries all of the RF from both input signals if the two input signals are in phase and coherent, the orthogonal output port carries the lagging signal if the input signals are coherent but either signal lags by 90 degrees, and the energy from both signals is present in part in each output port if the relationship between the signals differs from zero degrees and a 90 degree lag of one signal with respect to the other.

4. The directing apparatus of claim 2, wherein said switchless combiner further comprises a second two-port waveguide phase shifter, functionally identical to said first two-port waveguide phase shifter, the output of which second phase shifter is a second RF signal matching the input except for a propagation delay affecting all applied signals, the extent of which delay can be changed.

5. The directing apparatus of claim 2, wherein said switchless combiner further comprises a second two-port waveguide phase shifter, functionally differing from said first two-port waveguide phase shifter in having a different range of phase shift adjustment, the output of which second phase shifter is a second RF signal matching the input except for a propagation delay affecting all applied signals, the extent of which delay can be changed.

6. The directing apparatus of claim 2, wherein said switchless combiner further comprises a second two-port waveguide phase shifter, functionally differing from said first two-port waveguide phase shifter in having a fixed phase shift characteristic in lieu of an adjustable phase shift, the output of which second phase shifter is a second RF signal matching the input except for a fixed propagation delay of all applied signals.

7. The directing apparatus of claim 2, wherein said switchless combiner further comprises a two-port waveguide section, which waveguide section propagates RF signals within its passband at a nominal rate.

8. The directing apparatus of claim 1, wherein said filter-combiner further comprises:

a first filter hybrid, functionally equivalent to the four-port switchless combiner hybrids of the switchless combiner, into which first filter hybrid signals are fed from said switchless combiner at an entrance face comprising one or more ports and out of which first filter hybrid signals propagate at an exit face comprising one or more ports;

a second filter hybrid functionally equivalent to the four-port switchless combiner hybrids of the switchless combiner, into which second filter hybrid signals are fed at an entrance face comprising one or more ports and out of which second filter hybrid signals propagate at an exit face comprising one or more ports;

a first waveguide filter, comprising a succession of resonant sections, permitting RF signals in the range of frequencies of the passband to propagate from one port at the first filter hybrid exit face to one port at the second filter hybrid entrance face, and reflecting substantially all RF signals outside the passband; and a second waveguide filter functionally equivalent to the first waveguide filter.

9. The directing apparatus of claim 2, wherein said first four-port switchless combiner hybrid further comprises:

a first waveguide input port configured to admit an RF signal input;

a second waveguide input port configured to admit an RF signal input;

a first waveguide output port configured to emit an RF signal equivalent to the signal impinging on said first input port of said first switchless combiner hybrid, with a nominal phase angle, and to emit an RF signal equivalent to the signal impinging on said second input port of said first switchless combiner hybrid, with a phase angle lagging that of the other output port by 90 degrees; and a second waveguide output port configured to emit an RF signal equivalent to the signal impinging on said second input port of said first switchless combiner hybrid, with a nominal phase angle, and to emit an RF signal equivalent to the signal impinging on said first input port of said first switchless combiner hybrid, with a phase angle lagging that of the other output port by 90 degrees.

10. The directing apparatus of claim 2, wherein said second four-port switchless combiner hybrid further comprises:

a third waveguide input port configured to accept an RF signal input;

a fourth waveguide input port configured to accept an RF signal input;

a third waveguide output port, where said third output port is configured to emit an RF signal equivalent to the signal impinging on said third input port with a nominal phase angle, and where said third output port is further configured to emit an RF signal equivalent to the signal impinging on said fourth input port with the emitted signal characterized by a phase angle that lags that of the other input port signal by 90 degrees; and a fourth waveguide output port, where said fourth output port is configured to emit an RF signal equivalent to the signal impinging on said fourth input port with a nominal phase angle, and where said fourth output port is further configured to emit an RF signal equivalent to the signal impinging on said third input port with a phase angle that lags that of the other input port signal by 90 degrees.

11. The directing apparatus of claim 2, wherein said first two-port waveguide phase shifter further comprises:

an input port configured to admit an RF signal input;

an output port configured to emit an RF signal output;

a waveguide section connecting said input and output ports and capable of sustaining propagation of RF in the frequency band of interest;

a nonconductive block located within the RF propagation region of said waveguide section; and an adjustment mechanism permitting positioning of said nonconductive block at a plurality of locations within said waveguide section.

12. The directing apparatus of claim 11, wherein said nonconductive block is further characterized by:

a dielectric constant significantly different from that of free space;

a dissipation factor and other electrical and physical properties that permit indefinite operation of said nonconductive block in an environment with a sufficiently high RF energy level to be used for RF broadcast transmitters; and size sufficient to introduce a phase shift in the phase of RF signals propagating through said waveguide section, which phase shift varies through a range as the position of the block away from the sidewall of said waveguide section varies through a range.

13. The directing apparatus of claim 11, wherein said nonconductive block is capable of altering the extent to which the phase of RF signals propagating through said waveguide section is shifted by 90 degrees or more from the fully retracted to the fully extended position.

14. The directing apparatus of claim 11, wherein said nonconductive block is capable of altering the extent to which the phase of RF signals propagating through said waveguide section is shifted by 180 degrees or more from the fully retracted to the fully extended position.

15. The directing apparatus of claim 11, wherein the phase-altering material of said nonconductive block is Teflon®.

16. The directing apparatus of claim 11, wherein the phase-altering material of said nonconductive block is polytetrafluoroethylene.

17. The directing apparatus of claim 1, wherein the alteration of RF signal phase by actuation of the first phase shifter to the setting for 90 degrees of shift while leaving the second phase shifter at zero degrees of shift causes both of the output signals of the switchless combiner to be present on the first output port of the switchless combiner.

18. The directing apparatus of claim 1, wherein application of equal and coherent signals to said two inputs of said switchless combiner and actuation of said first phase shifter to the setting for 90 degrees of shift while leaving said second phase shifter at zero degrees of shift causes the output of the switchless combiner to comprise a single coherent signal on said first output port of the switchless combiner with energy practically equal to the sum of the input signal energies, while the second output port of the switchless combiner has practically zero output.

19. The directing apparatus of claim 1, wherein application of equal and coherent signals to said two inputs of said switchless combiner and actuation of said first phase shifter to the setting for 90 degrees of shift while leaving said second phase shifter at zero degrees of shift causes the output of said first output port of said filter-combiner to be practically zero and the output of said second output port of said filter-combiner to comprise a single coherent signal with energy practically equal to the sum of the input signal energies.

20. The directing apparatus of claim 1, wherein actuation of said first and second phase shifters to the setting for zero degrees of shift and application of equal and coherent signals to said two inputs of said switchless combiner causes the signal output of said first output port of said filter-combiner to be practically equal to the input signal on the first input of said switchless combiner, and further causes the signal output of said second output port of said filter-combiner to be practically equal to the input signal on the second input of said switchless combiner.

21. The directing apparatus of claim 1, wherein, if any combination of in-band signals within the power capacity of the apparatus is continuously applied to said first and second switchless combiner input ports, and if nonreflective loads are affixed to said filter-combiner output ports, then adjustment of said first and second phase shifters to any possible phase shift settings results in redirection of the input signals to said filter-combiner output ports without destructive effect, for any amount of change of phase shift setting, the rate of change being limited by the capacity of the apparatus to change setting.

22. An apparatus for directing high-power RF transmission signals, comprising:

means for accepting synchronous signals from a plurality of transmitters;

means for optionally combining the constituent signals;

means for directing the constituent signals to a plurality of output destinations in a plurality of configurations; and means for retaining signal path integrity during transitions between signal direction configurations, whereby impinging signals can continue to be accepted at representative power levels during transitions between configurations.

23. The apparatus of claim 22, wherein said RF directing apparatus further comprises means for altering the phase relationships between the signals.

24. A method of directing high-power RF transmitter signals comprising the following steps:

accepting signals from a plurality of synchronous broadcast transmitters at any level of signal strength matching;

directing signals from a plurality of transmitters to a plurality of output destinations in a plurality of configurations;

altering the phase relationship between the signals to a selectable degree;

combining the signals from the transmitters to a selectable degree; and varying the directing and combining of the signals continuously without requiring interruption of transmitter signal flow.

* * * * *